US005513926A

United States Patent [19]

Prescott

[11] Patent Number: 5,513,926

[45] Date of Patent: May 7, 1996

[54] MANHOLE HEAD ASSEMBLY

[76] Inventor: Alain Prescott, 102, De Gaulle, Ville de Lorraine, Canada, J6Z 3Z2

[21] Appl. No.: 411,323

[22] Filed: Mar. 27, 1995

[51] Int. Cl.[6] ..... E02D 29/14

[52] U.S. Cl. ..... 404/26; 52/20

[58] Field of Search ..... 404/25, 26; 52/20

[56] References Cited

U.S. PATENT DOCUMENTS

| | | | |
|---|---|---|---|
| 3,215,052 | 11/1965 | Lindstad et al. | 404/26 |
| 3,408,778 | 11/1968 | Mason . | |
| 4,121,390 | 10/1978 | Hall et al. | 404/26 X |
| 4,614,065 | 9/1986 | Papp | 404/26 X |
| 5,044,818 | 9/1991 | Pritchard | 404/26 |
| 5,205,668 | 4/1993 | Adams | 404/26 |

FOREIGN PATENT DOCUMENTS

| | | | |
|---|---|---|---|
| 1089275 | of 1980 | Canada . | |
| 1133739 | of 1982 | Canada . | |
| 1289799 | 10/1991 | Canada | 404/26 |
| 2074793 | of 1994 | Canada . | |
| 2069263 | of 1994 | Canada . | |
| 5263430 | 10/1993 | Japan | 404/26 |
| 459082 | 8/1968 | Switzerland | 404/26 |

*Primary Examiner*—William P. Neuder
*Attorney, Agent, or Firm*—Robic

[57] ABSTRACT

The manhole head assembly is for mounting a cover onto a manhole frame. This assembly has a lower annular rim member and an upper annular rim member. The lower member has a bottom side sized and shaped to rest on the manhole frame. It also has an opposite top side which has an inner surface portion sized and shaped to receive and support the peripheral bottom portion of the cover, and an outer surface portion. The upper annular rim member has a bottom side sized and shaped to rest onto the outer surface portion of the top side of the lower rim member in order to fully surround the peripheral edge of the cover when the same lays on the inner surface portion of the top side of the lower rim member. The upper annular rim member also has an opposite top side and a thickness substantially equal to the one of the peripheral sidewall of the cover. Bolts are used for anchoring to the manhole frame, the upper and lower rim members in operative position to receive and support the cover. Such a manhole head assembly is easy to assemble; it has a simple structure and can be vertically adjusted with one or more intermediate rim members to conform with new surface levels.

20 Claims, 5 Drawing Sheets

MANHOLE HEAD ASSEMBLY

BACKGROUND OF THE INVENTION

1. Field of the Invention

The present invention relates to a manhole head assembly for mounting a cover onto a manhole frame.

More specifically, the invention relates to a manhole head assembly that is vertically adjustable whenever desired to conform with a new surface level.

2. Description of Related Art

Known in the art is Canadian laid-open patent application No. 2,074,093 in the name of Gaetan BEGIN, which discloses a manhole head assembly having a plurality of stacked rubber rings to be mounted onto a manhole frame. Each ring is fastened only to the one below it, with the lowermost ring being fastened to the manhole frame. Such makes the assembly cumbersome to install. Moreover, the uppermost ring has an inner peripheral recess for supporting the cover, thereby making it necessary to use a mold of complex structure to manufacture it.

Also known in the art is U.S. Pat. No. 3,237,538 in the name of James H. McPHEETERS et al., which suggests to add a plurality of annular members to an existing manhole head in order to raise the cover to a new street level. A drawback of this invention is that it can only be installed onto an existing manhole head. Another drawback to this invention is that the installation of the annular members involves using a complicated system of dowels.

Also known in the art is U.S. Pat. No. 3,408,778 in the name of Keith K. MASON, which also discloses means for raising the manhole cover of an existing manhole head, which means have the same limitation as above, i.e. they can only be used onto an existing manhole head.

Although the art includes many other patents directed to manhole head assemblies, the three aforementioned patents are believed to be quite representative of the art in this field.

OBJECTS OF THE INVENTION

It is an object of the present invention to provide a manhole head assembly of very simple structure, which has a high degree of strength, stability and durability.

It is another object of the present invention to provide a manhole head assembly having the capability of being vertically adjustable, thereby allowing for relative ease of elevation of the manhole cover for conforming with a new surface level.

SUMMARY OF THE INVENTION

In accordance with the present invention, these objects are achieved with a manhole head assembly for mounting a cover onto a manhole frame, the cover having a peripheral sidewall of a given thickness and a peripheral bottom portion. The manhole head assembly comprises a lower annular rim member having a bottom side sized and shaped to rest on the manhole frame, and an opposite top side having an inner surface portion sized and shaped to receive and support the peripheral bottom portion of the cover, and an outer surface portion.

The manhole head assembly also comprises an upper annular rim member having a bottom side sized and shaped to rest onto the outer surface portion of the top side of the lower annular rim member in order to fully surround the peripheral edge of the cover when the same lays on the inner surface portion of the top side of the lower annular rim member. The upper member also comprises an opposite top side and a thickness substantially equal to the thickness of the peripheral sidewall of the cover.

A fastening element is provided for anchoring to the manhole frame the upper and lower annular rim members in operative position to receive and support the cover.

Preferably, this fastening element comprises at least one removable bolt having a head; at least one through hole extending from the top side to the bottom side of the upper annular rim member, the at least one through hole having a counterbore in the top side of the upper annular rim member sized to receive the head of the removable bolt; at least one through hole extending from the outer surface portion of the top side to the bottom side of the lower annular rim member; at least one bolt socket extending into the manhole frame. Thereby, in use, the upper and lower annular rim members can be connected to the frame by insertion of the at least one bolt into the holes of the upper and lower annular rim members and the at least one bolt socket after the holes and socket have been aligned.

Preferably also, the manhole head assembly further comprises a first locking mechanism on the outer surface portion of the top side of the lower annular rim member and on the bottom side of the upper annular rim member to prevent lateral movement of the upper annular rim member relative to the lower annular rim member, and a second locking mechanism on the bottom side of the lower annular rim member and on the manhole frame to prevent lateral movement of the lower annular rim member relative to the manhole frame.

Whenever desired, the manhole head assembly may further comprise at least one intermediate annular rim member for vertical position adjustment of the manhole cover. The intermediate annular rim member has a bottom side sized and shaped to rest on the top side of the lower annular rim member. It also has an opposite top side having an inner surface portion sized and shaped to receive and support the peripheral bottom portion of the cover, and an outer surface portion sized and shaped to receive and support the bottom side of the upper annular rim member.

As can be understood, the thickness of this intermediate rim may be selected to correspond to the thickness of the layer of asphalt added to the street or road.

The manhole head assembly according to the present invention is particularly useful in that it is easy to assemble, it has a simple structure, and it can be vertically adjusted to conform with any new surface level.

BRIEF DESCRIPTION OF THE DRAWINGS

In order to impart full understanding of the manner in which the above mentioned objects are achieved in accordance with the present invention, a detailed description of preferred embodiments thereof will now be given with reference to the accompanying drawings wherein.

DETAILED DESCRIPTION OF PREFERRED EMBODIMENTS OF THE INVENTION

Figure 1:
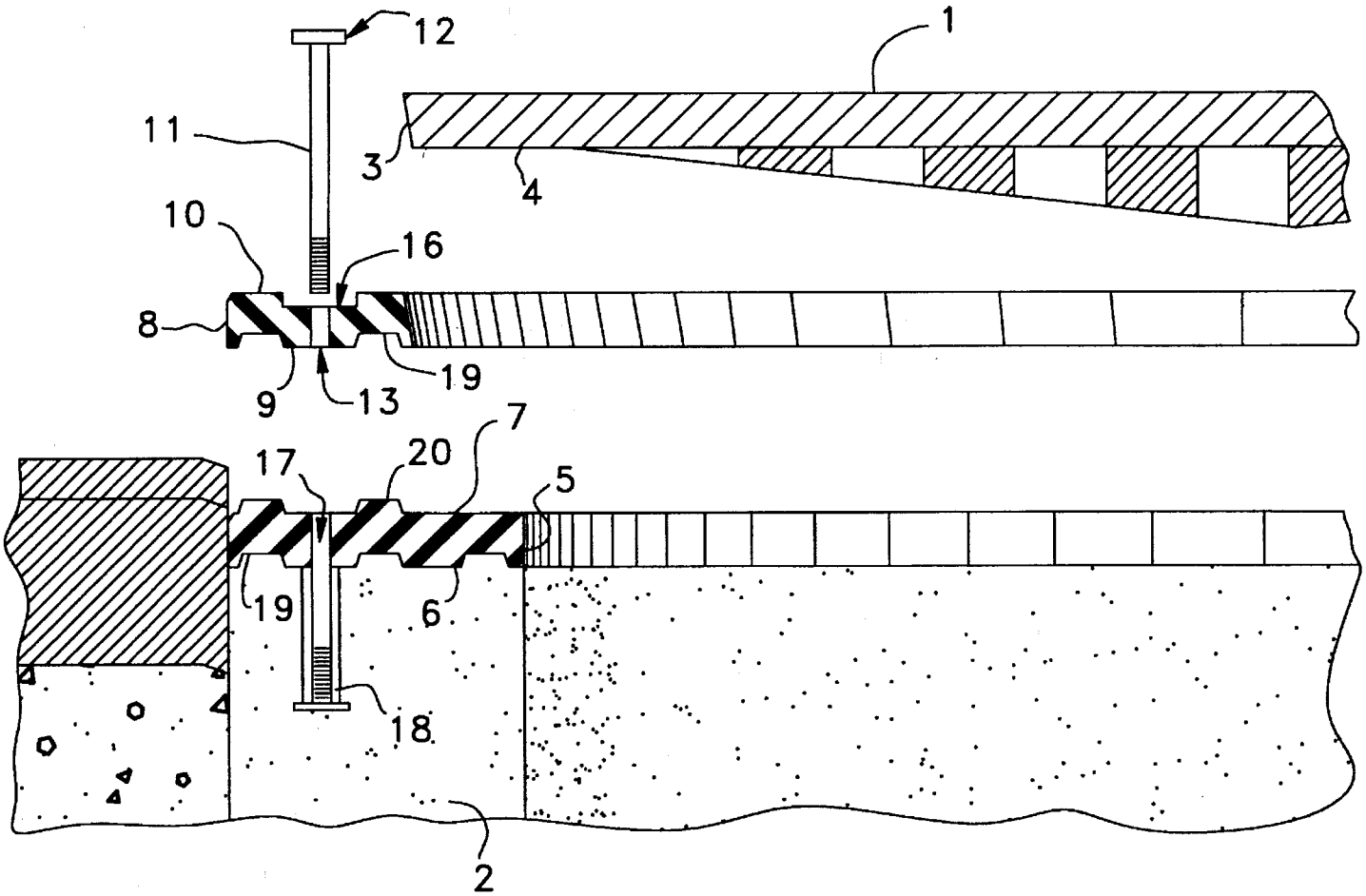
FIG. 1 is a side-elevational, cross-sectional view of a portion of a manhole head assembly according to the present invention, positioned for assembly onto a manhole frame.

In the following description and in the drawings, like reference numerals designate like or corresponding structural elements.

Figure 2:
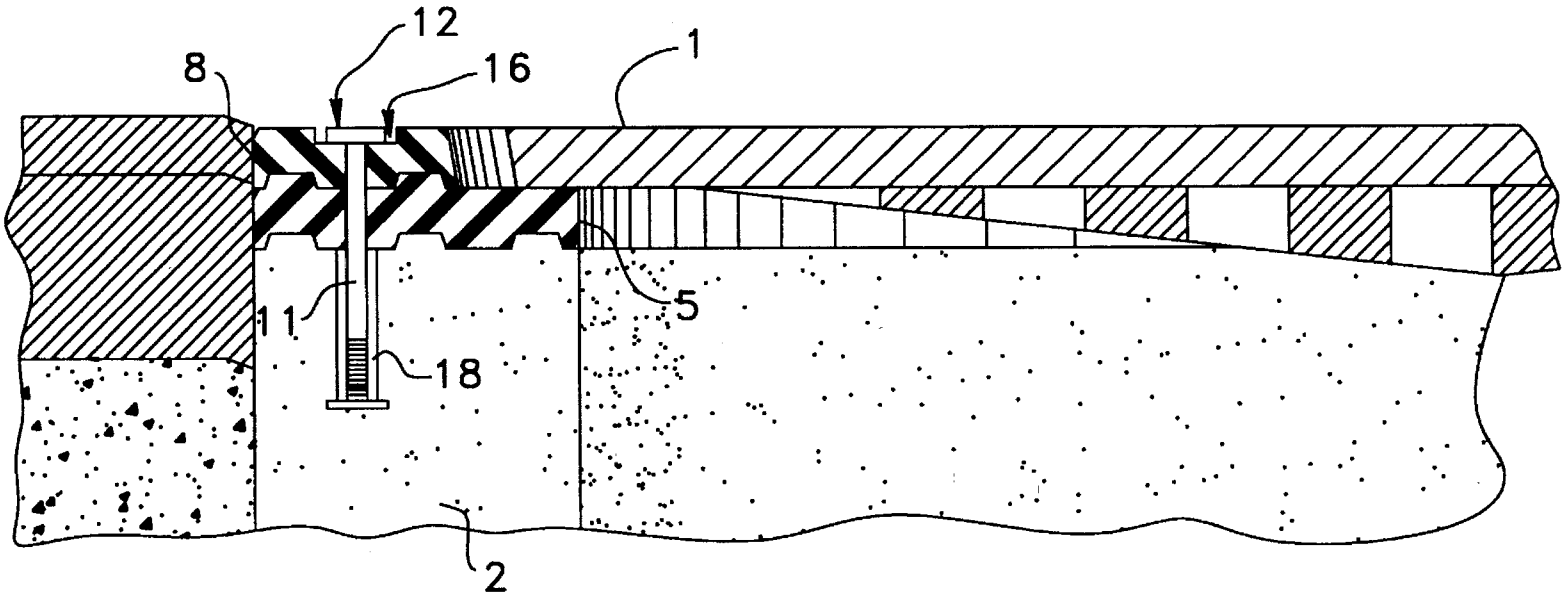
FIG. 2 is a side-elevational, cross-sectional view similar to the one of FIG. 1 showing the same portion of the manhole head assembly, once mounted onto a manhole frame.

Referring first to FIGS. 1 and 2, there is shown a manhole head assembly for mounting a cover 1 onto a manhole frame 2. The cover has a peripheral sidewall 3 of a given thickness and a peripheral bottom portion 4.

The manhole head assembly comprises a lower annular rim member 5 having a bottom side 6 sized and shaped to rest on the manhole frame 2, and an opposite top side 7. The opposite top side 7 of the lower annular rim member 5 has an inner surface portion sized and shaped to receive and support the peripheral bottom portion 4 of the cover 1. The opposite top side 7 of the lower annular rim member 5 also has an outer surface portion.

The manhole head assembly also comprises an upper annular rim member 8 having a bottom side 9 sized and shaped to rest onto the outer surface portion of the top side 7 of the lower rim member 5 in order to fully surround the peripheral edge 3 of the cover 1 when the same lays on the inner surface portion of the top side 7 of the lower annular rim member 5. The upper annular rim member 8 also has an opposite top side 10 and a thickness substantially equal to the one of the peripheral sidewall 3 of the cover 1.

The upper 8 and lower 5 annular rim members are circular in shape, this shape is preferred mainly for the reason that the rim members can easily be mounted onto a typical cylindrical manhole frame 2. Other shapes would also do, such as square or octagonal, in order to conform with a specific shape of a manhole frame onto which the rim members are to be mounted.

The upper 8 and lower 5 annular rim members are preferably made out rubber due to its resilient qualities. Other materials such as plastic, concrete or steel, would also do.

The manhole head assembly further comprises fastening elements which are equally distributed around the manhole for anchoring to the manhole frame 2 the upper 8 and lower 5 rim members in operative position to receive and support the cover 1.

Each fastening element comprises a removable bolt 11 having a head 12 and a through hole 13 extending from the top side 10 to the bottom side 9 of the upper annular rim member 8. The through hole 13 has a counterbore 16 in the top side 10 of the upper annular rim member 8 sized to receive the head 12 of the removable bolt 11 in order to keep the head 12 flush with the surface level. The fastening element also comprises another through hole 17 extending from the outer surface portion of the top side 7 to the bottom side 6 of the lower annular rim member 5 and at least one bolt socket 18 extending into the manhole frame 2, whereby, in use, the upper 8 and lower 5 annular rim members can be connected to the frame 2 by insertion of the removable bolt 11 into the through holes of said upper 8 and lower 5 annular rim members and the bolt socket 18 after the through holes and bolt socket 18 have been aligned as shown in FIG. 2. Although the bolts 11 anchoring the rim members to the manhole frame 2 are solid enough for preventing lateral movements of the rim members relative to the frame 2, the manhole head assembly may further comprise, as an extra precaution, a first locking mechanism consisting of matching tongues 20 and grooves 19 on the outer surface portion of the top side 7 of the lower annular rim member 5 and on the bottom side 9 of the upper annular rim member 8 to further prevent lateral movement of the upper annular rim member 8 relative to the lower annular rim member 5, and a second locking mechanism consisting of matching tongues 20 and grooves 19 on the bottom side 9 of the lower annular rim member 5 and on the manhole frame 2 to further prevent lateral movement of the lower annular rim member 5 relative to the manhole frame 2.

Other locking mechanisms besides matching tongues and grooves may also be used, such as complimenting corrugated surfaces.

Figure 3:
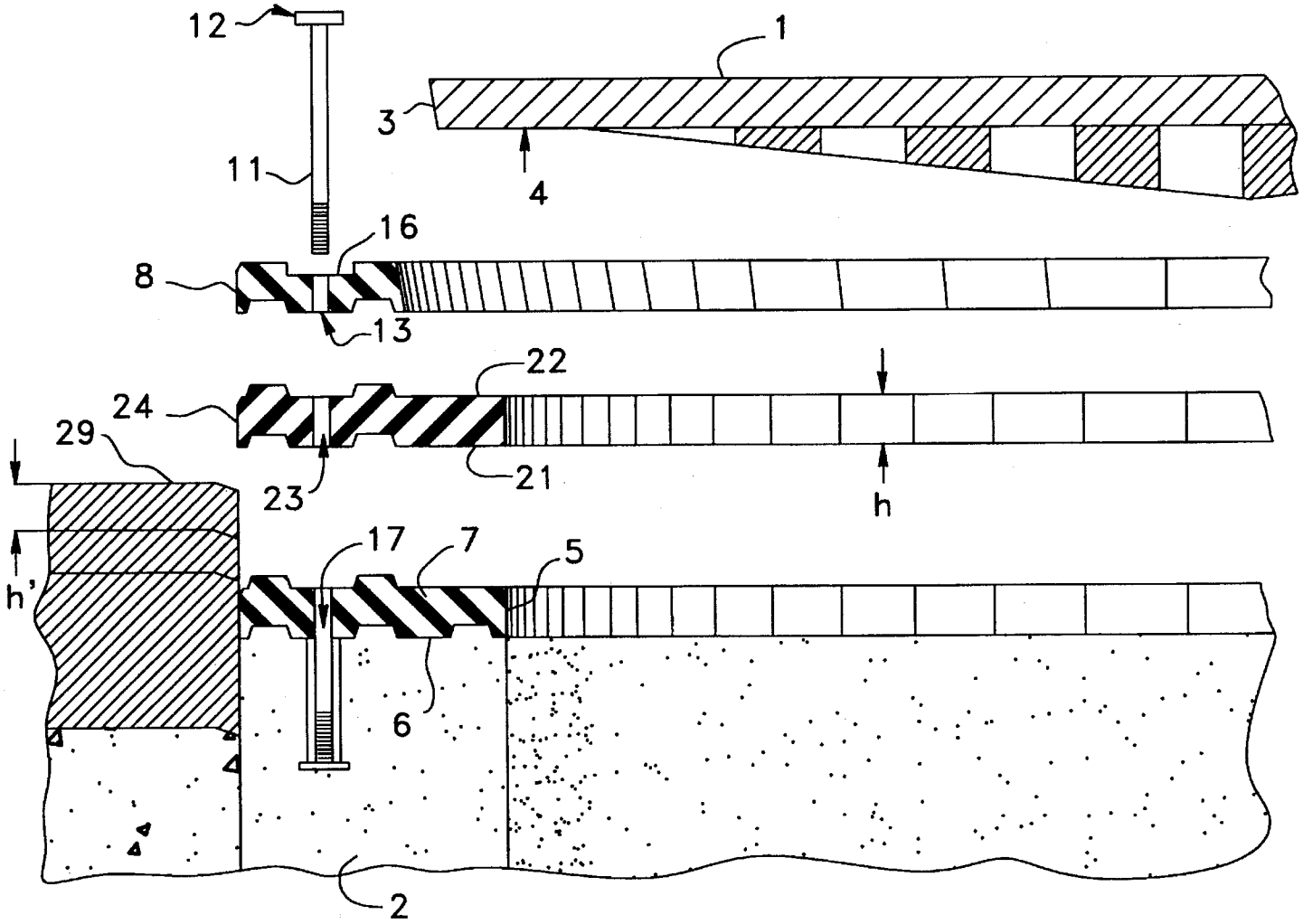
FIG. 3 is an exploded, cross-sectional view of the portion of a manhole head assembly as shown in FIG. 1, further comprising an intermediate annular rim member for vertically adjusting the manhole cover to conform with a new surface level.
Figure 4:
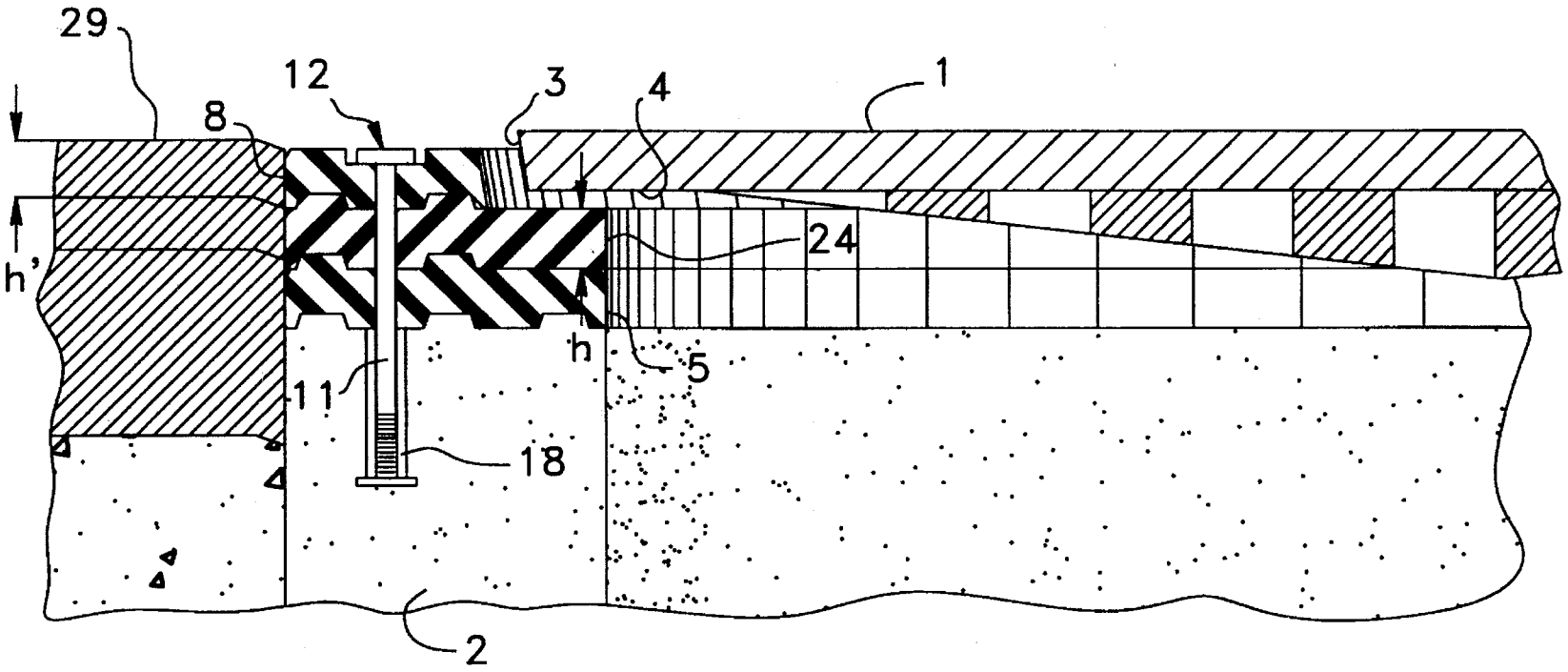
FIG. 4 is a side-elevational, cross-sectional view of the portion of the manhole head assembly shown in FIG. 3, once it is mounted onto a manhole frame.

Referring now to FIGS. 3 and 4, the manhole head assembly according to the present invention may also comprise an intermediate annular rim member 24 which is also circular in shape and made out of rubber. The intermediate annular rim member 24 can be used for vertical position adjustment of the manhole cover 1. It has a bottom side 21 sized and shaped to rest on the top side of the lower annular rim member 5 and an opposite top side 22. The top side 22 has an inner surface portion sized and shaped to receive and support the peripheral bottom portion 4 of the cover 1. The top side 22 also has an outer surface portion sized and shaped to receive and support the bottom side 9 of the upper annular rim member 8. The intermediate annular rim member 24 further has equally distributed through holes 23 extending from the top side 22 to the bottom side 21.

The intermediate annular rim member 24 can be chosen so that its thickness h is substantially equal to the thickness h' of the layer of asphalt applied to the street or road to achieve a new surface level 29, whatever be this thickness. If, for example, street resurfacing results in an increase of one inch to the original surface layer, then an intermediate annular rim member 24 of one inch in thickness will be chosen and positioned between the upper 8 and lower 5 annular rim members.

Of course, as is shown in FIGS. 3 and 4, such intermediate rim member 24 may be provided with tongues and grooves sized to match those of the upper and lower rim members, wherever necessary.

Figure 5:
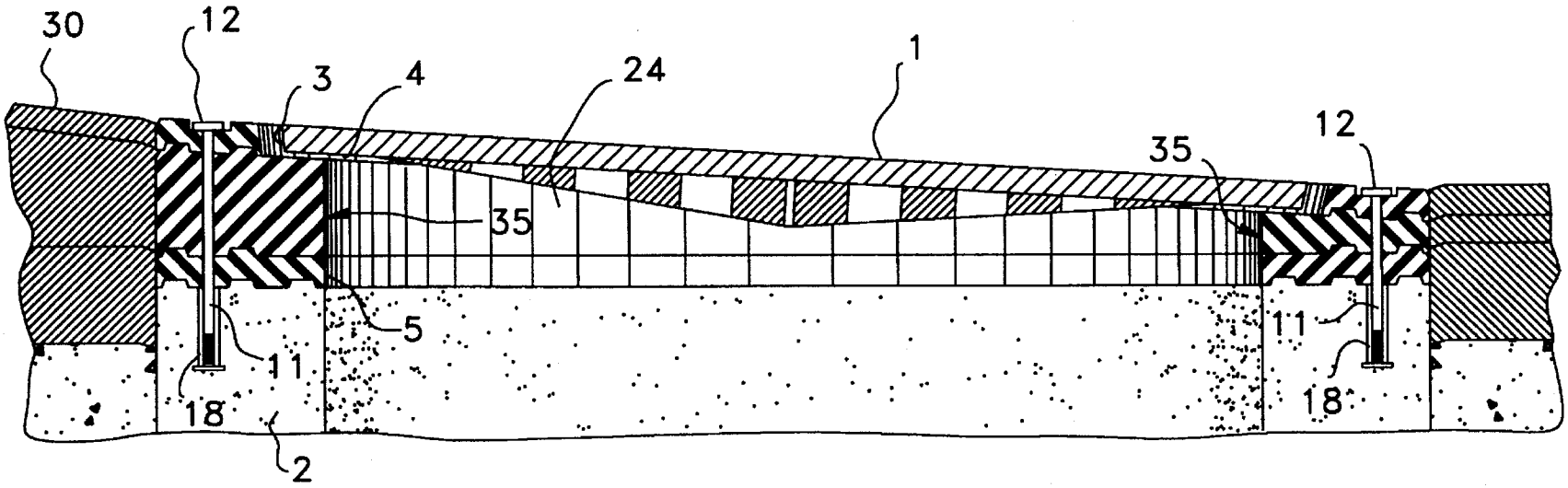
FIG. 5 is a side-elevational, cross-sectional view of a manhole head assembly according to the present invention, having an intermediate annular rim member with opposite rim portions of different thicknesses.

Referring to FIG. 5, there is shown the intermediate annular rim member 24 having opposite rim portions 35 of different thicknesses for maintaining the manhole cover 1 substantially flush with a sloped surface 30.

This rim member 24 may be provided in all shapes and sizes in order to conform with any surface level.

Although the present invention has been explained hereinafter by way of preferred embodiments thereof, it should be pointed out that any modifications to these preferred embodiments, within the scope of the appended claims, are not deemed to change or alter the nature and scope of the present invention.

The embodiments of the invention in which an exclusive property or privilege is claimed are defined as follows:

1. A manhole head assembly for mounting a cover onto a manhole frame, said cover having a peripheral sidewall of a given thickness and a peripheral bottom portion, said manhole head assembly comprising:

(a) a lower annular rim member having:
a bottom side sized and shaped to rest on the manhole frame; and
an opposite top side having:
an inner surface portion sized and shaped to receive and support the peripheral bottom portion of the cover; and
an outer surface portion;

(b) an upper annular rim member having:
a bottom side sized and shaped to rest onto the outer surface portion of the top side of the lower rim member in order to fully surround the peripheral edge of the cover when the same lays on the inner surface portion of the top side of the lower annular rim member;
an opposite top side; and
a thickness substantially equal to the thickness of the peripheral sidewall of the cover; and (c) a fastening means for anchoring to the manhole frame the upper and lower annular rim members in operative position to receive and support the cover.

2. The manhole head assembly according to claim 1, wherein said fastening means comprises:

at least one removable bolt having a head;

at least one through hole extending from the top side to the bottom side of the upper annular rim member, said at least one through hole having a counterbore in the top side of the upper rim member sized to receive the head of the removable bolt;

at least one through hole extending from the outer surface portion of the top side to the bottom side of the lower annular rim member; and at least one bolt socket extending into the manhole frame, whereby, in use, said upper and lower annular rim members can be connected to the frame by insertion of said at least one bolt into the holes of said upper and lower annular rim members and said at least one bolt socket after said holes and socket have been aligned.

3. The manhole head assembly according to claim 2, comprising:

a number of said at least one through hole in the upper annular rim member, which are equally distributed around the upper rim member;

a same number of said at least one through hole in the lower annular rim member, which are also equally distributed around the lower rim member;

a same number of bolts; and a same number of said at least one bolt socket, which are equally distributed around the manhole frame.

4. The manhole head assembly according to claim 1 further comprising:

(d) at least one intermediate annular rim member for vertical position adjustment of the manhole cover to conform with a new surface level, said intermediate rim member having:
a bottom side sized and shaped to rest on the top side of the lower annular rim member; and
an opposite top side having:
an inner surface portion sized and shaped to receive and support the peripheral bottom portion of the cover; and
an outer surface portion sized and shaped to receive and support the bottom side of the upper annular rim member.

5. The manhole head assembly according to claim 3 further comprising:

(d) at least one intermediate annular rim member for vertical position adjustment of the manhole cover to conform with a new surface level, said intermediate rim member having:
a bottom side sized and shaped to rest on the top side of the lower annular rim member; and
an opposite top side having:
an inner surface portion sized and shaped to receive and support the peripheral bottom portion of the cover; and
an outer surface portion sized and shaped to receive and support the bottom side of the upper annular rim member.

6. The manhole head assembly according to claim 4, wherein the intermediate annular rim member has a thickness substantially equal to a thickness of the new surface level.

7. The manhole head assembly according to claim 1 further comprising:

(c) a first locking means on the outer surface portion of the top side of the lower annular rim member and on the bottom side of the upper annular rim member to prevent lateral movement of the upper annular rim member relative to the lower annular rim member; and
a second locking means on the bottom side of the lower annular rim member and on the manhole frame to prevent lateral movement of the lower annular rim member relative to the manhole frame.

8. The manhole head assembly according to claim 3 further comprising:

(c) a first locking means on the outer surface portion of the top side of the lower annular rim member and on the bottom side of the upper annular rim member to prevent lateral movement of the upper annular rim member relative to the lower annular rim member; and
a second locking means on the bottom side of the lower annular rim member and on the manhole frame to prevent lateral movement of the lower annular rim member relative to the manhole frame.

9. The manhole head assembly according to claim 5 further comprising:

(c) a first locking means on the outer surface portion of the top side of the intermediate annular rim member and on the bottom side of the upper annular rim member to prevent lateral movement of the upper annular rim member relative to the intermediate annular rim member; and
a second locking means on the bottom side of the lower annular rim member and on the manhole frame to prevent lateral movement of the lower annular rim member relative to the manhole frame.

10. The manhole head assembly according to claim 9, wherein said first and second locking means consist of matching tongues and grooves.

11. The manhole head assembly according to claim 3, wherein said manhole frame and said upper and lower rim members are circular in shape.

12. The manhole head assembly according to claim 5, wherein said manhole frame and said upper and lower rim members are circular in shape.

13. The manhole head assembly according to claim 9, wherein said manhole frame and said upper and lower rim members are circular in shape.

14. The manhole head assembly according to claim 1, wherein said upper and lower rim members are made out of a resilient material.

15. The manhole head assembly according to claim 3, wherein said upper and lower rim members are made out of a resilient material.

16. The manhole head assembly according to claim 5, wherein said upper, lower and intermediate rim members are made out of resilient material.

17. The manhole head assembly according to claim 9, wherein said upper, lower and intermediate rim members are made out of resilient material.

18. The manhole head assembly according to claim 16, wherein said resilient material is rubber.

19. The manhole head assembly according to claim 4, wherein said intermediate annular rim member has opposite rim portions of different thickness.

20. The manhole head assembly according to claim 5, wherein said intermediate annular rim member has opposite rim portions of different thickness.

* * * * *